US011250753B2

(12) United States Patent
Ito

(10) Patent No.: US 11,250,753 B2
(45) Date of Patent: Feb. 15, 2022

(54) EMI MITIGATION BY SHIFTED SOURCE LINE PRE-CHARGE

(71) Applicant: SYNAPTICS INCORPORATED, San Jose, CA (US)

(72) Inventor: Daisuke Ito, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 64 days.

(21) Appl. No.: 16/850,447

(22) Filed: Apr. 16, 2020

(65) Prior Publication Data

US 2021/0327322 A1 Oct. 21, 2021

(51) Int. Cl.
*G09G 3/20* (2006.01)

(52) U.S. Cl.
CPC ..... *G09G 3/20* (2013.01); *G09G 2310/0251* (2013.01); *G09G 2310/0297* (2013.01); *G09G 2320/0223* (2013.01); *G09G 2330/06* (2013.01)

(58) Field of Classification Search
CPC ..... G09G 3/20; G09G 2310/0251; G09G 2310/0297; G09G 2320/0223; G09G 2330/06; G09G 5/10
See application file for complete search history.

(56) References Cited

U.S. PATENT DOCUMENTS

2008/0079711 A1* 4/2008 Ishii ..... H04N 9/312 345/215
2009/0230945 A1* 9/2009 Smoot ..... G01V 3/088 324/67
2011/0090194 A1* 4/2011 Chang ..... H01L 27/14609 345/207
2013/0100173 A1* 4/2013 Chaji ..... G09G 3/3275 345/690
2014/0210698 A1* 7/2014 Huang ..... G09G 3/3614 345/98
2018/0151107 A1 5/2018 Yabuki
2019/0286767 A1* 9/2019 Okuda ..... G06F 30/20
2020/0043392 A1* 2/2020 Fujikawa ..... G09G 3/006

FOREIGN PATENT DOCUMENTS

KR 102000008101 2/2000
KR 1020090061458 A 6/2009
KR 1020110066507 6/2011

OTHER PUBLICATIONS

International Search Report dated Jul. 29, 2021 in International Patent Appl. No. PCT/US2020/027621 filed Apr. 16, 2021.

* cited by examiner

*Primary Examiner* — Dmitriy Bolotin
(74) *Attorney, Agent, or Firm* — Leydig, Voit & Mayer, Ltd.

(57) ABSTRACT

A method of driving pixels of a display device includes, for a set of N pixels of the display device that are connected to a switch, each of the N pixels to be driven during a time period T, applying, to a first pixel of the set, a first pre-charge signal, and applying, in sequence, to each remaining pixel of the set, a corresponding pre-charge signal, such that the start of the pre-charge signal for a Kth pixel is delayed by a time Δtk, from the start of the pre-charge signal for the (K−1)th pixel.

19 Claims, 12 Drawing Sheets

EMI MITIGATION BY SHIFTED SOURCE LINE PRE-CHARGE

TECHNICAL FIELD

Embodiments of the present disclosure generally relate to display devices, for example in automobiles, and in particular to mitigation of electromagnetic interference (EMI) by shifting in time source line pre-charging of the display device.

BACKGROUND

Automotive applications require suppression of EMI noise to avoid interference with other electrical components that may operate in the automobile. In general, the EMI noise suppression requirements for automotive applications are significantly more restrictive than those for mobile applications, such as, for example, smartphones, tablets and notebook computers.

Display devices utilizing multiplexer (MUX) switching systems have been used to connect one input to multiple outputs via a set of switches equal to the number of outputs. These systems reduce the number of output pads needed to connect a display driver integrated circuit (IC) to a display panel, thereby allowing smaller border width at a driver side of the display panel, as well as a smaller chip size for the display driver IC. In a conventional method of driving the display panel, as is shown for example in FIG. 3A, each of the MUX switches is sequentially turned on once per horizontal period of the display device.

Due to this sequential turning on of the MUX switches several times per horizontal period, noise is generated each time a switch is turned on, or closed. The frequencies of the noise can directly interfere with the longwave (LW) band and their higher order harmonics can interfere with the amplitude modulation (AM) band. As a result, the conventional switching method results in a significant noise signal that may be detected in an EMI test, especially in automotive implementations.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

Disclosed embodiments describe a display device, and related display panel switching system, that mitigates EMI noise from a display panel, without degrading the quality of the images being displayed.

In one embodiment, a method for driving pixels of a display device is disclosed. The method refers to a set of N pixels of the display device that are connected to a switch, each of the N pixels to be driven during a time period T. The method includes applying, to a first pixel of the set, a first pre-charge signal, and applying, in sequence, to each remaining pixel of the set, a corresponding pre-charge signal, such that the start of the pre-charge signal for a Kth pixel is delayed by a time Δtk, from the start of the pre-charge signal for the (K−1)th pixel.

In some embodiments, the time Δtk for a Kth pixel is the same for each of the N pixels, and is also less than the duration of the pre-charge signal for an immediately prior (K−1)th pixel.

In another embodiment, a display device is disclosed. The display device includes a display panel including a plurality of pixels, a gate driver configured to enable the plurality, and a display driver coupled, via a multiplexing switch, to each of the pixels of the plurality. The display device further includes a processor, coupled to the gate driver and the display driver, configured to control the gate driver to enable the plurality of pixels, and the display driver to apply, to a first pixel of the plurality, a first pre-charge signal. The processor is further configured to apply, in sequence, to the remaining pixels of the plurality, a corresponding pre-charge signal, such that the start of the pre-charge signal for a Kth pixel of the plurality is delayed by a time Δtk, from the start of the pre-charge signal for the (K−1)th pixel of the plurality.

In another embodiment, a method for driving pixels of a display device is disclosed. The method includes setting, within a pre-defined period of the display device, a pre-charge signal to be followed by a pixel driving signal for each pixel in a set of pixels. The method further includes setting the pre-charge signal for a first pixel of the set of pixels at a beginning of the pre-defined period, and, for each of the remaining pixels in the set of pixels, staggering a beginning of each corresponding pre-charge signal so that there is a minimum delay between any two pre-charge signals. The method still further includes driving the set of pixels during one or more pre-defined periods, measuring a level of electromagnetic interference (EMI) generated when driving the set of pixels, and outputting a value for the EMI to a user.

BRIEF DESCRIPTION OF THE DRAWINGS

So that the manner in which the above-recited features of the present disclosure may be understood in detail, a more particular description of the disclosure, briefly summarized above, may be had by reference to embodiments, some of which are illustrated in the appended drawings. It is noted, however, that the appended drawings illustrate only some embodiments of this disclosure and are therefore not to be considered limiting of its scope, for the disclosure may admit to other equally effective embodiments.

Figure 1:
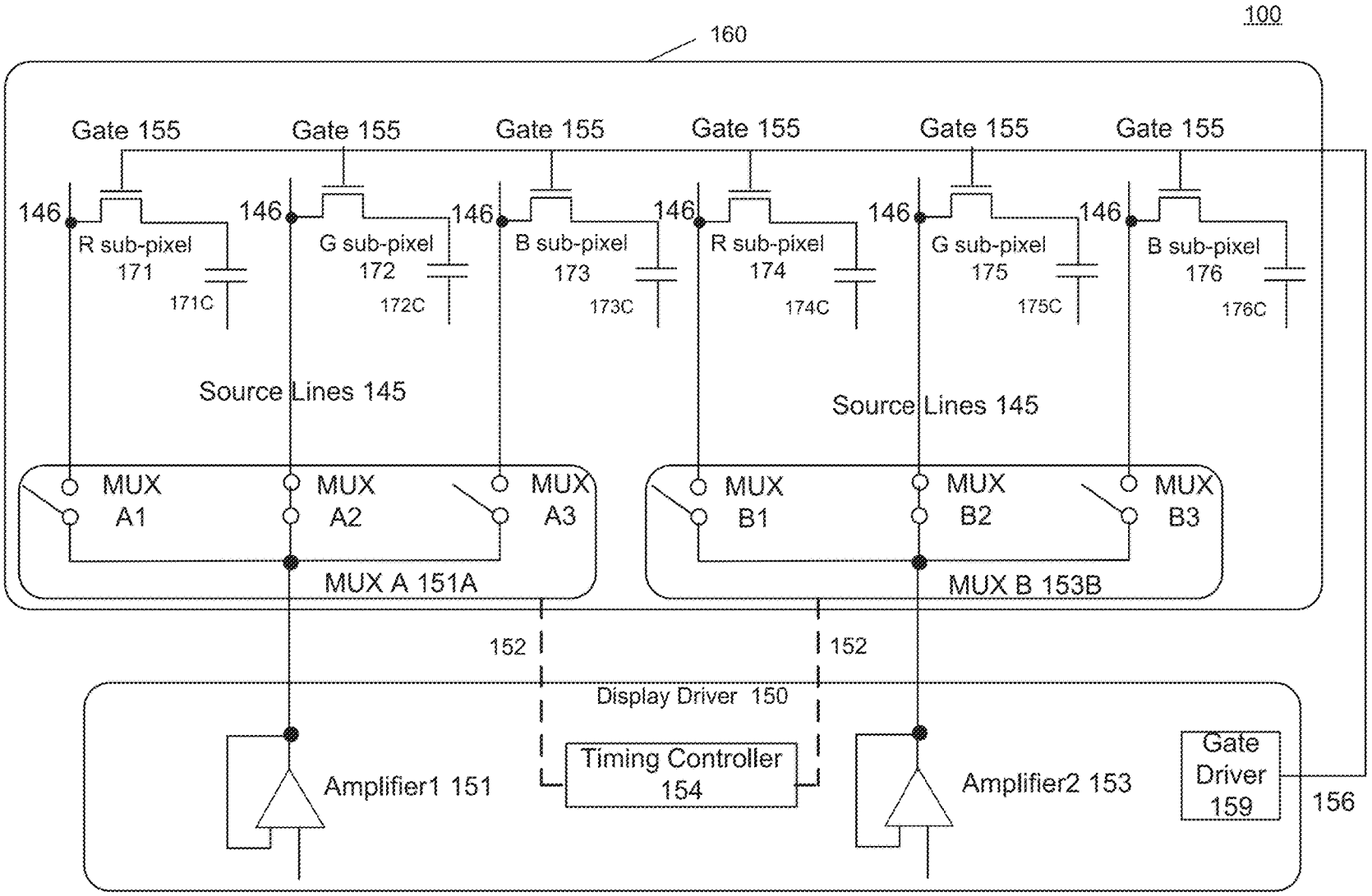
FIG. 1 depicts an example display device configured to sequence pre-charging of pixels, according to one or more embodiments.

To facilitate understanding, identical reference numerals have been used, where possible, to designate identical elements that are common to the Figures. It is contemplated that elements disclosed in one embodiment may be beneficially utilized on other embodiments without specific recitation. The drawings should not be understood as being drawn to scale unless specifically noted. Also, the drawings may be simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

The following description may use perspective-based descriptions such as top/bottom, in/out, over/under, and the like. Such descriptions are merely used to facilitate the discussion and are not intended to restrict the application of embodiments described herein to any particular orientation.

The following description may use the phrases "in one embodiment," or "in one or more embodiments," or "in some embodiments", which may each refer to one or more of the same or different embodiments. Furthermore, the terms "comprising," "including," "having," and the like, as used with respect to embodiments of the present disclosure, are synonymous. The terms "coupled with," along with its derivatives, and "connected to" along with its derivatives, may be used herein, including in the claims. "Coupled" or "connected" may mean one or more of the following. "Coupled" or "connected" may mean that two or more elements are in direct physical or electrical contact. However, "coupled" or "connected" may also mean that two or more elements indirectly contact each other, but yet still cooperate or interact with each other, and may mean that one or more other elements are coupled or connected between the elements that are said to be coupled with or connected to each other. The term "directly coupled" or "directly connected" may mean that two or elements are in direct contact.

As used herein, including in the claims, the term "circuitry" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

As used herein, including in the claims, a "display device" may refer to a user device that has both display and touch screen functionality. The display device may have a display panel as well as a display driver. As used herein, including in the claims, the terms "display panel", or "display/touch panel" refer to the actual upper surface of a display device, on which the images are displayed, which a user may touch, and/or over which a user may hover, to interact with a touch sensing functionality of the display device. When the focus of the discussion is on the touch sensing aspect of the display/touch panel, as the case may be, it may be also be referred to as a "touch screen."

In one or more embodiments, EMI emitted from a display panel of a display device may be mitigated by shifting or staggering pre-charge timing for a set of pixels. In one or more embodiments, the pixels are driven by an amplifier connected to a common switch, such as, for example, a multiplexer (MUX) switch that connects a single input to multiple outputs. In one or more embodiments, each pixel may include a MOSFET transistor, and the pixel may be driven by first enabling the gate of the MOSFET, and then applying a voltage to its source. In one or more embodiments, for each pixel, a pre-charge voltage is first applied at a beginning of a horizontal display refresh period, followed by a pixel driving voltage. In one or more embodiments, the pre-charge voltages are staggered. Thus, each pre-charge voltage is sequentially applied to each source line such that each pixel's pre-charge voltage is applied after a pre-defined time delay from the start of the previous pixel's pre-charge voltage. In some embodiments, a noise frequency may be one-third that of a conventional MUX switching system, which improves EMI noise levels in both the LW and AM bands.

Liquid crystal displays (LCDs), Organic Light emitting Diodes (OLEDs) and other display devices utilize multiplexer (MUX) switching systems. In general, a MUX switching system connects one input to multiple outputs via a set of switches equal to the number of outputs. These systems reduce the number of output pads needed to run from a display driver integrated circuit (IC) to a display panel. This allows for both a smaller border width at a driver side of the display panel, as well as a smaller chip size for the display driver IC. For example, in the case of a three MUX switch system, each MUX in the display panel is connected to a set of three pixels (or sub-pixels). In the conventional method of driving a display panel, each of the MUX switches is sequentially turned on once per horizontal period of the display device to supply a driving voltage to a pixel or a sub-pixel.

EMI noise is generated each time a switch is turned on, or closed. For a horizontal period of the display device between 33 kHz-66 kHz, the noise frequency for, for example, a three MUX switch system would be between 100-200 kHz. These noise frequencies directly interfere with the LW band (150 kHz 300 kHz). Moreover, their higher order harmonics interfere with the AM band (530 kHz-1.8 MHz). As a result, the conventional switching method results in a significant noise signal that may be detected in an EMI test. In an automobile context there are strict limits on EMI noise. Thus it is advantageous to reduce it to the extent possible.

Pre-charge signals may be provided to a set of pixels or sub-pixels of a display device that are driven by a single amplifier. In one or more embodiments, while the pre-charge signals are respectively provided to the set of pixels at the beginning of a horizontal period of the display device, the pre-charge signals are not sent at the same time. Rather, they are shifted in time, or staggered. In one or more embodiments, a first pre-charge signal is provided to a first pixel (or sub-pixel) of the set, and then, after a first time delay, a second pre-charge signal is sent to a second pixel (or sub-pixel) of the set, and then, after a second time delay, a third pre-charge signal is sent to a third pixel (or sub-pixel) of the set, and so on, until all of the pre-charge signals have been sent, each after a time delay following the start time of the previous pre-charge signal. As used herein, the feature of sending each next pre-charge signal after a delay from the previous pre-charge signal may be referred to as "shifting" the pre-charge signals, or "staggering" the pre-charge signals, or as "shifting/staggering" the pre-charge signals.

FIG. 1 illustrates a schematic diagram of an example display device 100, according to one or more embodiments. The display device 100 includes a display driver 150, and a display panel 160. The display panel 160 includes a plurality of groups of sub-pixels, each group connected, via a MUX switch, to an amplifier that may be provided in the display driver 150. The display device 100 may be implemented in, for example, a smartphone, laptop computer, desktop computer, public kiosk, or in-vehicle infotainment system. As stated above, the display device 100 may also be equipped with touch screen functionality.

Continuing with reference to FIG. 1, the display driver 150 supplies driving signals, e.g., as voltages, to the display panel 160, and thus to each of the six sub-pixels 171-176 of display panel 160. As noted, display driver 150 may include a number of amplifiers, each amplifier supplying a voltage signal to a plurality of pixels or sub-pixels of display panel 160. For ease of presentation, only two amplifiers are shown in FIG. 1, namely amplifier1 151 and amplifier2 153, each of which drives three sub-pixels in display panel 160. It is understood that display driver 150 may include any number of amplifiers to respectively drive one or more pixels of the display panel 160, and that display panel 160 may include various numbers of pixels that are connected to, and thus driven by, each amplifier. In one or more embodiments, each of the amplifiers 151, 153 is connected to the input of a MUX switch. In one or more embodiments, each MUX switch includes at least two switches. In the example embodiment of FIG. 1, each MUX switch has three switches, but in alternate embodiments each MUX switch may include two, or more than three, switches. For example, as shown in FIG. 1, amplifier1 151 is connected to MUX A 151A, which includes three switches MUX A1, MUX A2 and MUX A3, and amplifier2 153 is connected to MUX B 153B, which includes three switches MUX B1, MUX B2 and MUX B3.

Continuing with reference to FIG. 1, the display driver 150 also includes a timing controller 154. The timing controller 154, via a set of control links 152 (shown as dashed lines), controls when each switch within each MUX, e.g., switches MUX A1, MUX A2 and MUX A3 in MUX A 151A, and switches MUX B1, MUX B2 and MUX B3 in MUX B 153B, opens and closes. Thus, timing controller 154, control links 152, and the two MUX switches, namely MUX A 151A and MUX B 153B, may collectively be referred to as a "switching system" of the display panel 160.

Conventionally, only one switch of each MUX is closed at a time, once per horizontal period of the display device, to provide one of the sub-pixels connected to the MUX with its appropriate brightness signal for that horizontal period, known herein as a "pixel signal." As is illustrated in FIG. 1, in each of MUX A 151A, and MUX B 153B, only the middle switch is closed (MUX A2 and MUX B2, respectively). Thus, in the example of FIG. 1, only the green sub-pixel in each of the two sets of sub-pixels is currently being driven.

As noted above, sequentially closing each of the switches of a MUX in a horizontal period generates excessive EMI noise. In another conventional approach, each switch of each MUX is closed for a brief time at the beginning of each horizontal period to "pre-charge" the sub-pixel. The closing of the switch during this brief initial time delivers a signal to each switch, which is referred to herein as a "pre-charge signal." Thus, with reference to the example of FIG. 1, in this alternate conventional approach, during a brief time interval at the beginning of a horizontal period all three switches of each of MUX A 151A and MUX B 153B would be closed (this is not shown in FIG. 1). However, while the pre-charge approach resolves some of the noise generated when a MUX switch is later closed in the same horizontal period to deliver the pixel signal, it also generates significant noise when all three switches are closed at the beginning of the horizontal period for the pre-charge signal. In one or more embodiments, this noise generated by the pre-charge signals may be reduced by staggering, or shifting in time, the various pre-charge signals.

Continuing with reference to FIG. 1, in some embodiments, the amplifiers 151, 153, and the timing controller 154 may be integrated in one single chip. In alternate examples, the amplifiers 151, 153 may be separated from the timing controller 154, e.g., be provided in a different chip.

As shown in FIG. 1, the signal from each amplifier is provided to a MUX switch, which supplies the signal to each of three pixels connected to it. In some embodiments, the pixels may be sub-pixels, and may thus include each of red (R), green (G) and blue (B) sub-pixels, as shown in FIG. 1. Or, for example, the pixels may be sub-pixels used in an alternate sub-pixelated display, such as, for example, one that is ordered as blue, green and red (BGR), or one that uses a color system with more than three primaries, such as, for example, the red, green, blue and yellow (RGBY), or red, green, blue and white (RGBW) color systems, or, for example, the red, green, blue, yellow and cyan (RGBYC) color system. It is thus understood that the techniques and methods of the present disclosure may be applied to any set of pixels that are connected to a single switch or switching device, whether the pixels are sub-pixels, or individual pixels, and which are used in connection with any black and white, greyscale, or color system, of whatever type.

Thus, for example, continuing with reference to FIG. 1, in an example sub-pixelated display using an example RGB color system, amplifier1 151 is connected to MUX A 151A, which is connected to the three sub-pixels R 171, G 172 and B 173, and, similarly, amplifier2 153 is connected to MUX B 153B, which is connected to the three sub-pixels R 174, G 175 and B 176. In one or more embodiments, each sub-pixel may include a transistor, such as, for example, a MOSFET transistor. The MOSFET transistor may be turned on, or selected, by a voltage applied to its gate 155. Once it is selected, a voltage applied to its source 146, via one of source lines 145, is passed to a pixel electrode or LED of the sub-pixel, indicated in the example of FIG. 1 as LEDs 171C through 176C. These LEDs are shown schematically as a capacitance, which each LED includes, and it is this capacitance that is both initially pre-charged (via a pre-charge signal) and later charged (via a pixel signal) in a horizontal display period, as described below, by a voltage supplied to it by its respective amplifier, when its respective MUX switch is turned on. As noted above, the value of the voltage applied at the MOSFET's source 146 by a pixel signal determines the brightness of the sub-pixel. In alternate examples, which utilize an LCD display panel 160 (which has no LEDs), the voltages are passed to a pixel electrode.

Continuing with reference to FIG. 1, in one or more embodiments, sub-pixels R 171, G172, B 173, R 174, G 175 and B 176 may all be provided in a row, such as, for example, as part of an array of pixels of the display panel 160. In order to select one row of an example pixel array at a time, the gates 155 of all of the sub-pixels in the row may be connected, as shown. Thus, in one or more embodiments, the display driver 150, via gate drivers 159, may send an enabling signal to each sub-pixel in a row of a pixel array provided on display panel 160. In one or more embodiments, the enabling signal may be, for example, a gate enabling voltage sent over row enabling link 156, to each of the gates 155 of each of the sub-pixels in the row. For ease of presentation, the sub-pixels R 171, G172, B 173, R 174, G 175 and B 176 of FIG. 1 constitute two pixels of one example row. An example array of three rows, each row including two pixels and thus six sub-pixels, and thus being similar to the single row of FIG. 1, is illustrated in FIG. 2, next described.

Figure 2:
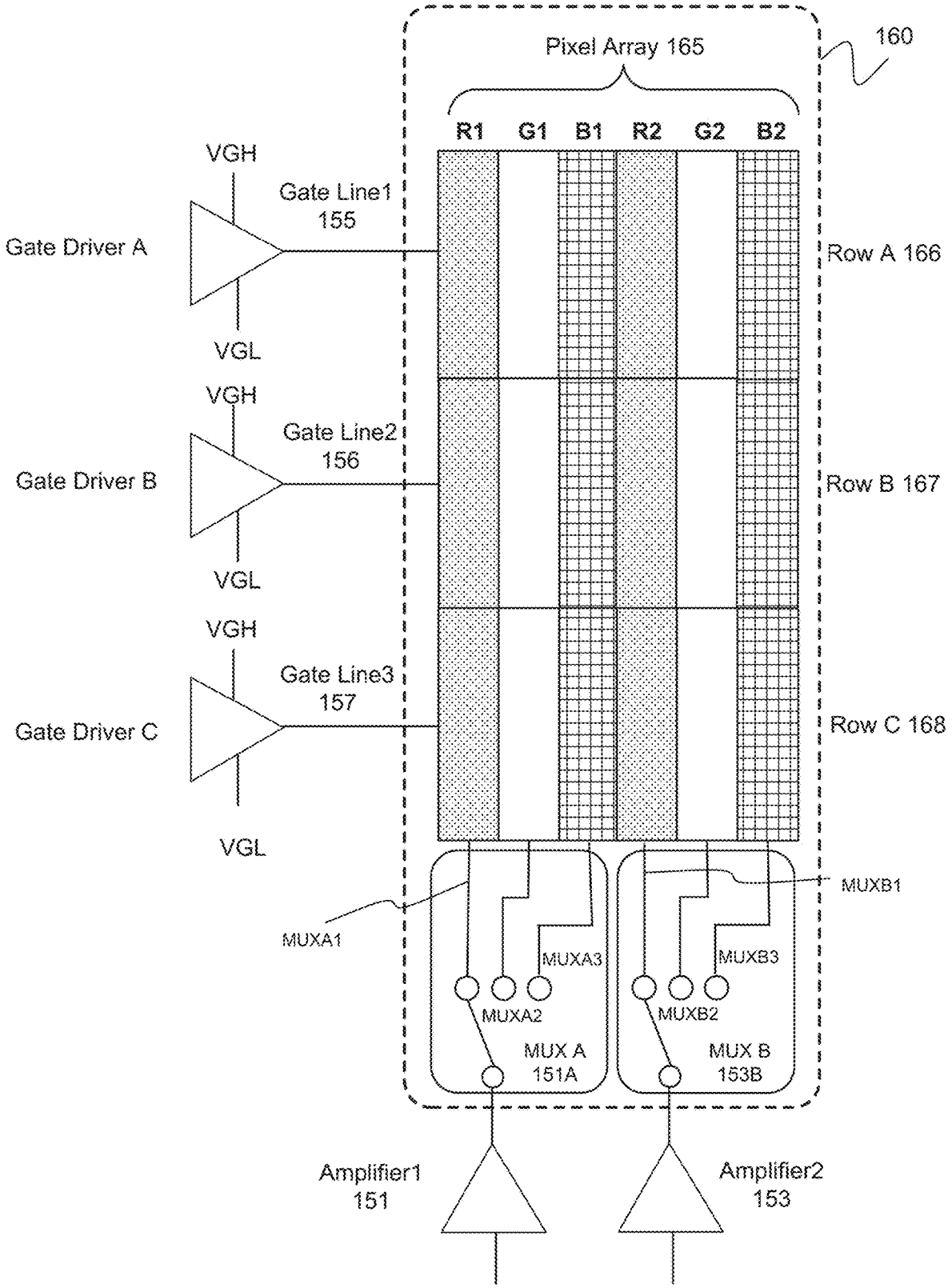
FIG. 2 depicts an example pixel array of the example display device of FIG. 1, according to one or more embodiments.

FIG. 2 depicts an example pixel array 165 of the example display panel 160 of the display device 100, according to one or more embodiments. The pixel array 165, as well as MUX A 151A and MUX B 153B, are provided within the display panel 160, whose boundary is indicated by the dashed rectangle in FIG. 2. The pixel array 165 includes at least three rows of six sub-pixels per row, being row A 166, row B 167 and row C 168, respectively. Row A 166 is the row of sub-pixels shown in FIG. 1, and rows B 167 and C 168 are each equivalent to row A 166. In the example pixel array of FIG. 2, as was the case in the example of FIG. 1, the pixels are sub-pixels of two actual pixels. Thus, each row of pixel array 165 incudes sub-pixels R1, G1, B1, and R2, G2 and B2. For ease of illustration, all of the red sub-pixels are shown with a dotted rectangle, all of the green sub-pixels with a white rectangle, and all of the blue sub-pixels are shown in a white rectangle with black grid lines.

As described above, the gates of the sub-pixels of each row of pixel array 165 may all be connected, and may receive an enabling signal that selects the entire row to be refreshed. The enabling signal turns on a transistor of each sub-pixel for the duration of a refresh period, as shown in FIG. 1 and descried above, thereby allowing the sub-pixel to receive a source voltage from a corresponding amplifier that determines its brightness value for the refresh period, known as the horizontal period. Thus, continuing with reference to FIG. 2, for row A 166 there is a gate driver A that supplies the enabling signal, over gate line1 155. Similarly, for row B 167 there is a gate driver B that supplies the enabling signal, over gate line2 156, and finally, for row C 167 there is a gate driver C that supplies the enabling signal, over gate line3 157. The gate drivers thus allow the display driver of the display device to sequentially move through all of the rows of the display panel 160 (for example, from top row to bottom, or from bottom row to top, or in some other row interleaving schema) to generate an image that is displayed on the display panel 160. While an individual row is enabled by its associated gate driver, the signals supplied by the amplifiers that are respectively connected to the columns of that row are thus passed to the sub-pixels of the enabled row in a sequence determined by the display driver and its timing controller. Such a sequence is implemented by turning on and off the MUX switches in each of MUX A 151A and MUX B 153B.

As described above, in the example of FIGS. 1 and 2, the respective source voltage signals for each group of three sub-pixels are supplied by a single amplifier, either amplifier1 151 or amplifier2 153. The gate drivers 159 as well as the amplifiers 151, 153 may be provided, for example, in the display driver circuitry, which may, for example, be an IC, or a portion of an IC. Thus, the amplifiers 151 and 153 are shown as being outside of the display panel 160.

Continuing with reference to FIG. 2, as noted above, within each row of the pixel array 165, during each horizontal refresh period, the three sub-pixels that are driven by a single amplifier are each driven with a source voltage so that they display a desired brightness. In addition, in one or more embodiments, at the beginning of each horizontal refresh period, a pre-charge voltage may also be applied, where the beginning of each respective pre-charge voltage is delayed in time from the beginning of the one that preceded it. Thus, for example, in one or more embodiments, the amplifier1 151, which supplies the source voltages for each of sub-pixels R1, G1 and B1, under the control of the display driver, sends a pre-charge voltage to sub-pixel R1 of row A 166 at the beginning of a horizontal refresh period. After a pre-defined delay, the amplifier1 151 sends a pre-charge voltage to sub-pixel G1 of row A 166, and after another pre-defined delay, sends a pre-charge voltage to sub-pixel B1 of row A 166. In one or more embodiments, the pre-defined delays have the same duration, but in alternate embodiments, two or more, or even all, of the pre-defined delays may have different durations. In one or more embodiments, the duration of the pre-charge signal is of sufficient time to charge the relevant sub-pixel's source line.

Figure 3A:
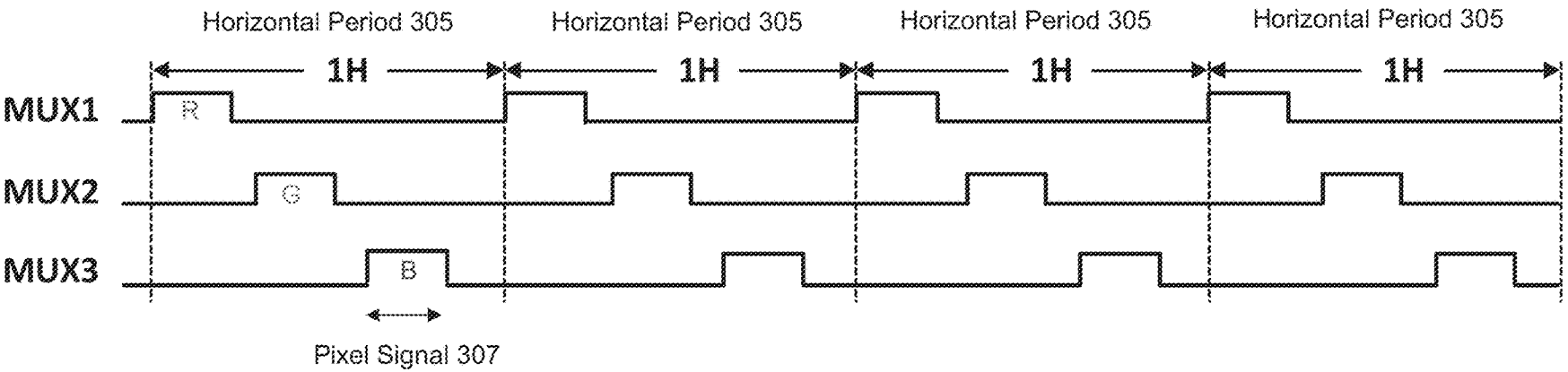
FIG. 3A illustrates an example set of conventional driving signals for each of a red, green and blue sub-pixel, over four example horizontal periods of a conventional display device.
Figure 3B:
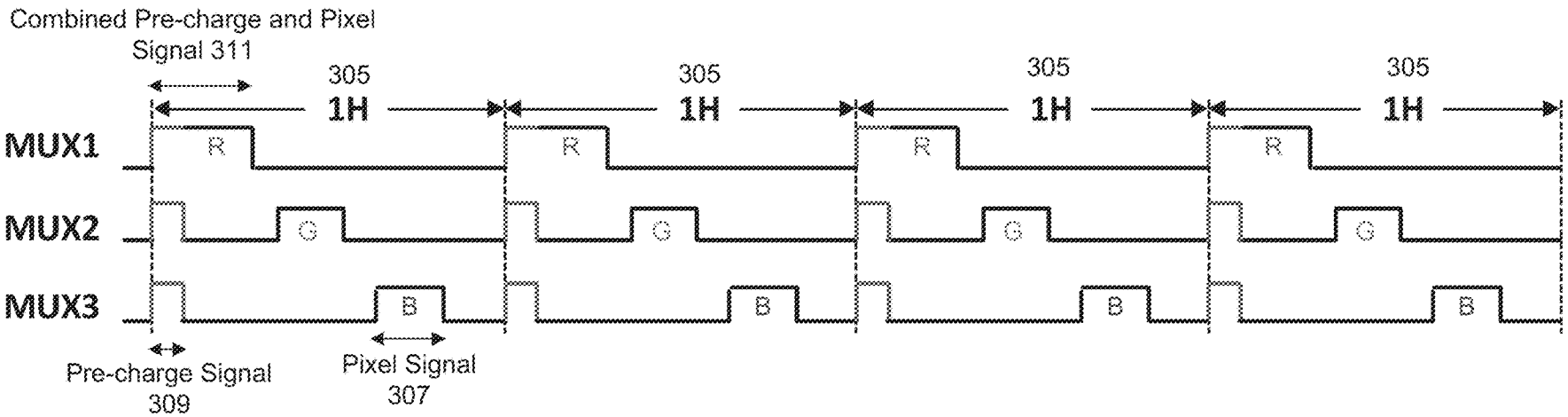
FIG. 3B illustrates an example set of conventional driving signals having a pre-charge signal for each sub-pixel, over four example horizontal periods of a conventional display device.

FIGS. 3A and 3B, next described, illustrate conventional methods for driving a set of sub-pixels, with and without pre-charging. As noted above, each of these methods generates significant EMI noise, and is thus problematic, especially in display devices used in automobiles, trucks or the like, which, as noted above, have strict limits on EMI.

FIG. 3A illustrates an example set of conventional driving signals for each of a red, green and blue sub-pixel, over four example conventional horizontal periods 305 of a display device. The plots shown in FIG. 3A may together be referred to as a "timing diagram" for a set of pixels, and in this case, for a set of sub-pixels. The depicted signals are voltage signals provided to a MUX switch connected to each of the red, green and blue sub-pixels, as is illustrated in FIG. 1 and described above. Each of the depicted signals of FIG. 3A thus controls whether or not a corresponding MUX switch is closed (and thus on) or open (and thus off). In one or more embodiments, the respective MUX switches may be controlled by a metal oxide (MOS) transistor, for example. In one or more embodiments, the transistor may be either a PMOS or an NMOS transistor.

Continuing with reference to FIG. 3A, there are three signal plots in the timing diagram, one for each of the three MUX switches in such an example embodiment. Thus, the three plots are labeled by the name of the corresponding switch, namely MUX1 (connected to red sub-pixel), MUX2 (connected to green sub-pixel) and MUX3 (connected to blue sub-pixel). In each of the three plots, the x axis is time, and the y-axis is voltage. As shown, the signals provided in each horizontal period are similar for each of the three switches, and they respectively turn on an individual MUX switch for a pixel driving signal supplied by the amplifier, which corresponds to a desired brightness level for each sub-pixel. Thus, when a MUX switch is turned on, the voltage then supplied by the amplifier is passed to a source line of the sub-pixel, as shown above in FIGS. 1 and 2. As shown in FIG. 3A, at the beginning of each horizontal period MUX1 turns on and allows an amplifier connected via the set of MUX switches to each of the red, green and blue sub-pixels to provide a pixel driving signal to the red sub-pixel as long as the MUX1 switch is connected. Such a pixel driving signal is illustrated in FIG. 3A, as well as in all of the timing diagrams in subsequent figures, by pixel signal 307, which is a voltage pulse that, for example, goes high and thereby turns on the MUX1 switch, lasts for a duration, and then goes low, thereby turning off the MUX1 switch. The red sub-pixel signal is followed by MUX2 turning on in the middle of the horizontal period, via its own pixel signal, after MUX1 has turned off, so that the amplifier may provide a pixel driving signal to the green sub-pixel. Finally, after MUX2 has turned off, a third pixel signal 307 turns on MUX 3, which then passes a pixel driving signal from the amplifier to the blue sub-pixel.

Thus, the waveforms shown in FIG. 3A (as well as in FIG. 3B and other figures herein) represent the control signals that turn on and off the MUX switches. In the illustrated example, a high voltage level indicates that the switch is on, and therefore that the source line of that sub-pixel is connected to its amplifier, and a low level indicates that they are disconnected. This is because in the example of FIG. 3A, the opening and closing of the MUX switches is performed by an NMOS transistor, which requires a "high" gate voltage to turn on. In alternate examples, where the MUX switches are controlled by a PMOS transistor, which requires a "low" gate voltage to turn on, the polarity of high and low will be opposite from that shown in the various figures.

FIG. 3B illustrates the example set of conventional driving signals of FIG. 3A with an added pre-charge signal 309 applied to each sub-pixel, over four example horizontal periods of a conventional display device. With reference to FIG. 3B, as shown, in this example the three pre-charge signals are applied simultaneously, to all three sub-pixels, at the start of each horizontal period 305. For ease of illustration, each pre-charge signal is shown in FIG. 3B as more lightly shaded than the remainder of that MUX switch's signal line. As was the case in FIG. 3A, the timing diagram of FIG. 3B shows when each MUX switch is turned on, and when it is turned off. As shown, the respective pre-charge signals 309 are applied for a duration and then go low, and the duration of the pre-charge signal 309 is the same for each MUX switch, and is also less than the duration of a pixel signal 307. To implement this example timing, the MUX initially turns on all three of its switches, e.g., MUX1, MUX2 and MUX3, simultaneously, and passes the pre-charge voltage that is generated by the amplifier to each sub-pixel for the duration of the pre-charge signal 309. Because all three switches are on, and thus all pass the voltage supplied by the amplifier, the pre-charge voltage is the same for each sub-pixel. Then, for example, the MUX turns switches MUX2 and MUX3 off, but continues to leave MUX1 on, now passing the pixel signal for the red sub-pixel to it for its pixel signal 309. Thus, as shown, MUX1 stays closed, and thus turned on, for a total duration of the sum of the individual durations of signals 307 and 309, in a "combined pre-charge and pixel signal" 311. Using a combined pre-charge and pixel driving signal, as shown, offers benefits for noise and power consumption. However, in other examples, such as are illustrated in FIGS. 4C and 4D and described below, a pre-charge signal 309 may go low just before an immediately following pixel signal 307 goes high, and thus, in such examples, there is no combined pre-charge and pixel signal, but rather, first the MUX switch goes on for the pre-charge signal, then is turned off, and then it is again turned on essentially right away, and stays on while the amplifier provides the corresponding sub-pixel with its pixel signal.

It is here noted that because precise voltage charging of a given pixel or sub-pixel is not necessary for pre-charge signals, but is necessary during the actual charging times (e.g., during respective pixel signals 307), in some embodiments the duration of a pre-charge signal 309 may be less than that of an actual charging signal 307, as shown. In alternate embodiments however, the duration of the pre-charge signal 309 may be the same as, or even greater than, that of the pixel signal 307.

Additionally, although in FIG. 3B the durations of all of the respective pre-charge signals 309 are shown as being the same for all sub-pixels, this is not required, and in alternate embodiments different pixels or sub-pixels of a display device, or of one or more rows of a display device, may have different pre-charge signal 309 durations.

As noted above, and as described below with reference to FIGS. 5A and 5B, each of the example conventional driving signals respectively illustrated in FIGS. 3A and 3B generate noise when the MUX switches turn on. Thus, in one or more embodiments, to minimize, or otherwise reduce, the noise, the pre-charge signals 309 are not applied as shown in FIG. 3B, but rather time delayed from one another. As noted, such use of delays between the start of successive pre-charge signals for a given MUX switch may be referred to as "shifting" or "staggering" the pre-charge signals. Examples of staggered pre-charge signals according to an embodiment are illustrated in FIGS. 4A and 4B, next described.

Figure 4A:
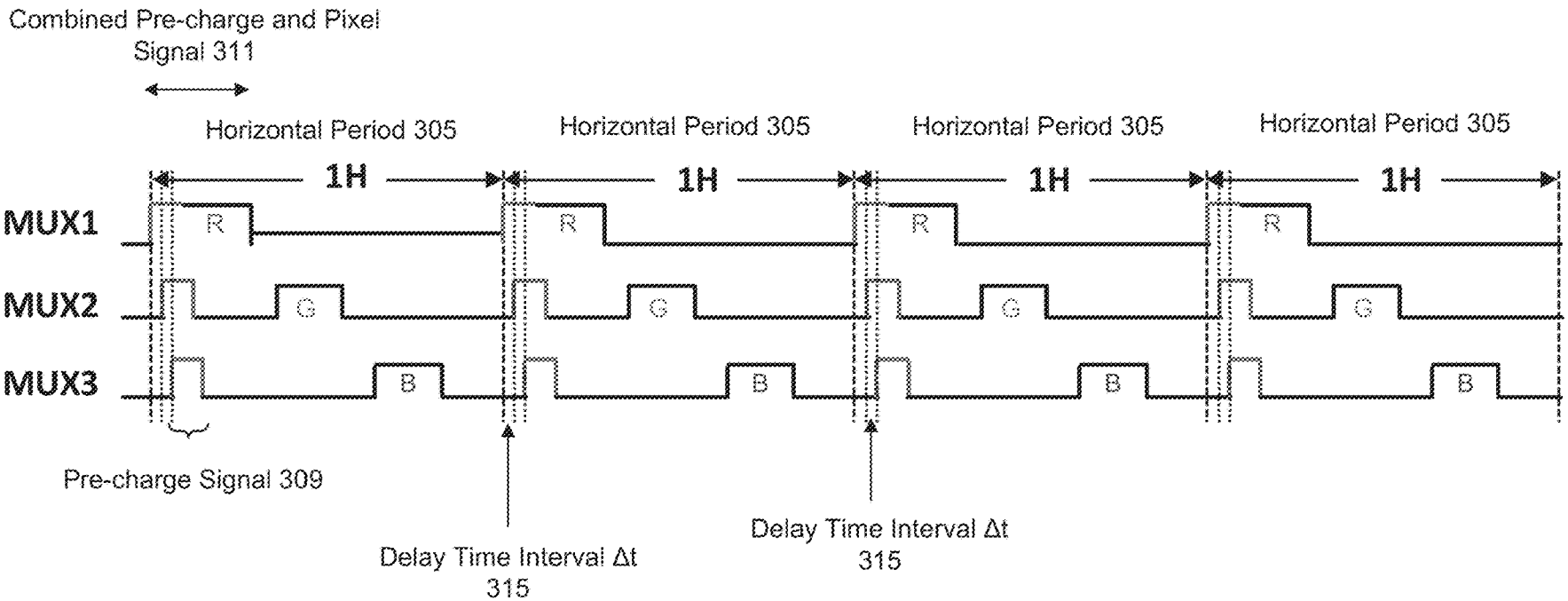
FIG. 4A illustrates an alternate example set of driving signals, including pre-charge signals for each sub-pixel, over four example horizontal periods of a display device, according to one or more embodiments.

FIG. 4A illustrates a set of driving signals that include staggered pre-charge signals for each of a red, green and blue sub-pixel over four example horizontal periods of a display device, according to one or more embodiments. Thus, as shown in FIG. 4A, at the beginning of the horizontal period 305 a pre-charge signal 309 is initially applied to a first sub-pixel, in this example the red sub-pixel, by turning on (closing) MUX1. After a first delay time interval Δt 315, MUX2 is turned on, and a pre-charge signal is then applied to the green sub-pixel. After a second delay Δt 315, while MUX1 and MUX2 are still on, as shown, MUX3 is turned on, and a pre-charge signal 309 applied to the blue sub-pixel. This staggered sequence of pre-charge signals 309 occurs at the beginning of each horizontal period 305, as shown. In order to more clearly illustrate the signals and their respective onset times and durations, a single horizontal period of FIG. 4A is shown, in a magnified view, in FIG. 4B, next described.

Figure 4B:
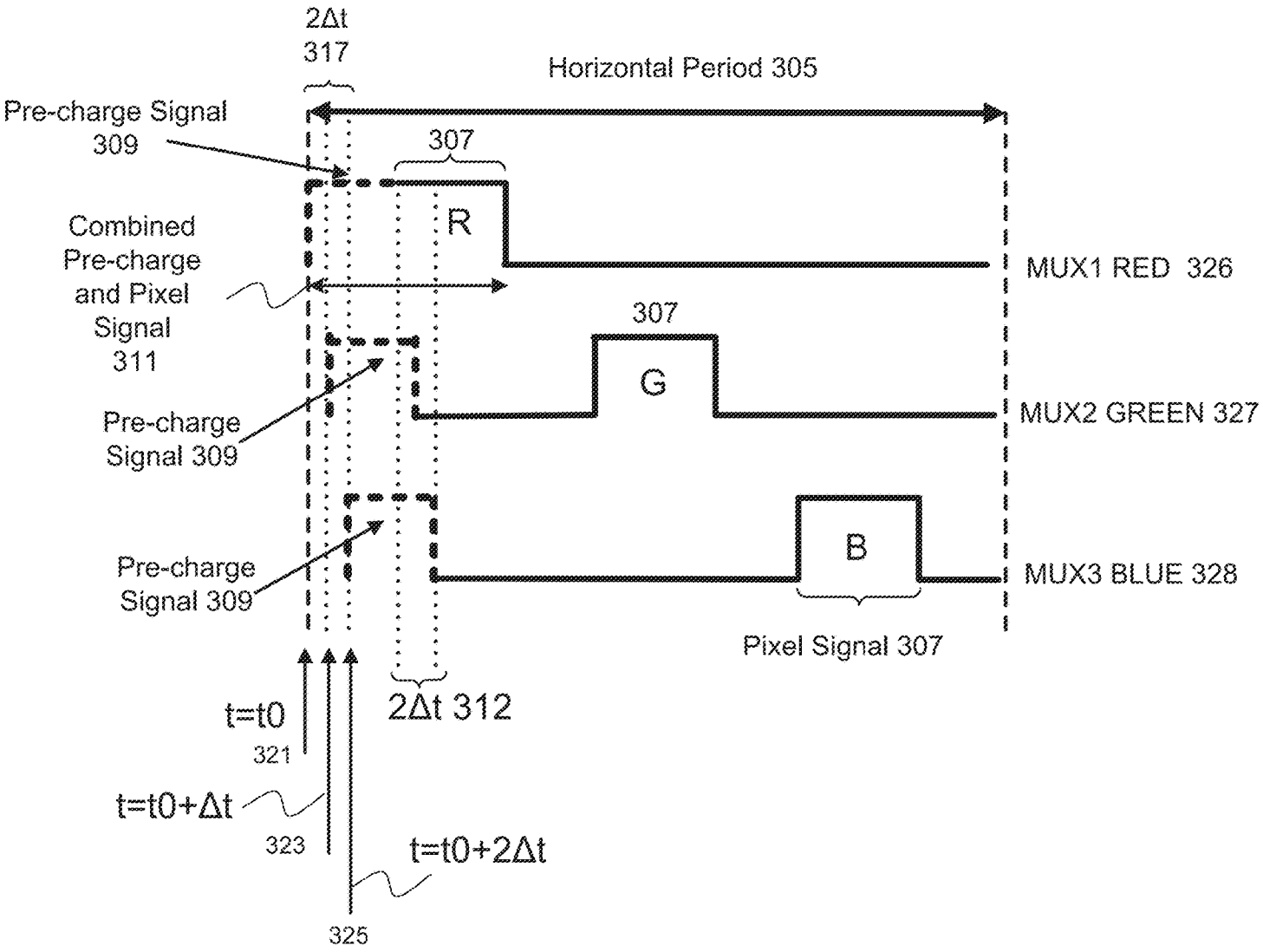
FIG. 4B is an enlarged view of a portion of the signals shown in FIG. 4A.
Figure 4C:
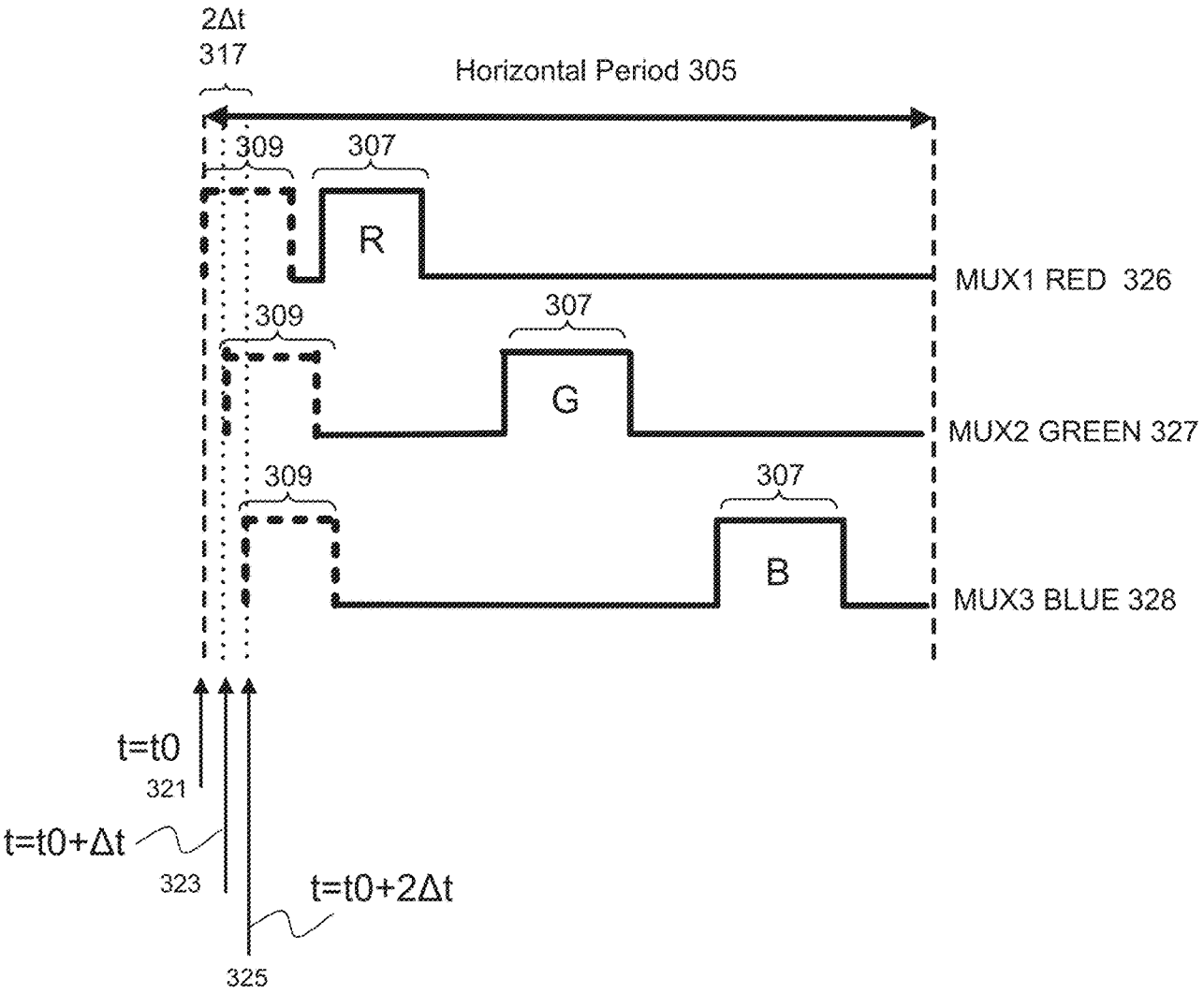
FIG. 4C illustrates an alternate example of the driving signals, according to one or more embodiments.
Figure 4D:
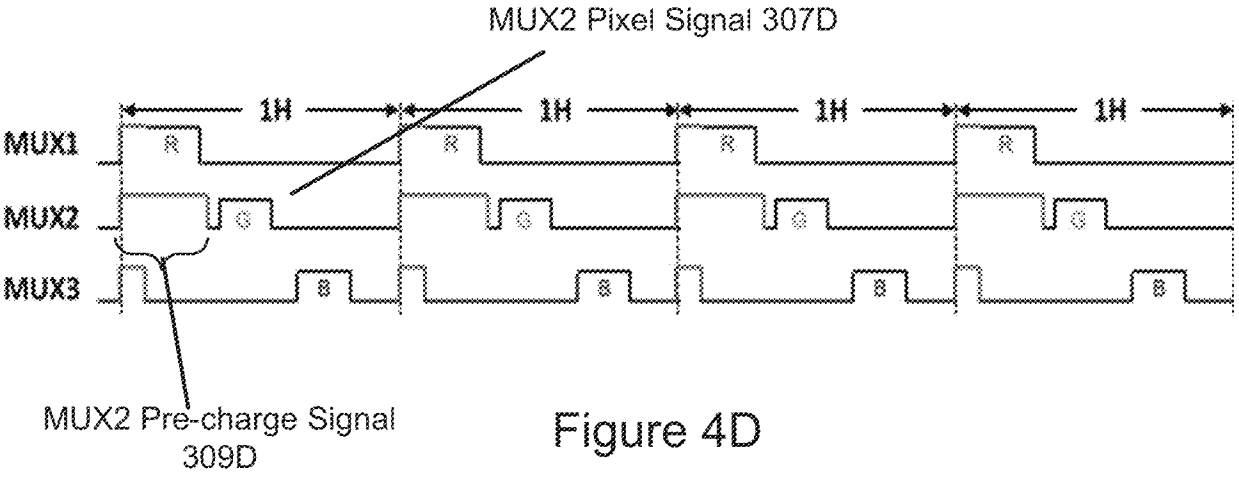
FIG. 4D illustrates another example of the driving signals, according to one or more embodiments.

FIG. 4B is a magnified portion of one of the horizontal periods 305 shown in FIG. 4A, according to one or more embodiments. As shown in FIG. 4B, the horizontal period 305 begins at time t=t0 321. Δt that time, the MUX1 RED switch 326 is turned on for pre-charge signal 309, and the pre-charge voltage generated by the amplifier (which feeds all three of the sub-pixels in FIG. 4B) is passed to the red sub-pixel. While the pre-charge signal is still high for the red sub-pixel, and the amplifier continues to provide a pre-charge voltage signal to the red sub-pixel, after, for example, a delay Δt, at time t=t0+Δt 323, the MUX2 GREEN switch 327 is turned on, and the pre-charge voltage generated by the amplifier is then also passed to the green sub-pixel, as its pre-charge signal 309. Then, while the pre-charge signal is still high for both the red sub-pixel and the green sub-pixel, after another delay Δt, at time t=t0+2Δt 325, the MUX3 BLUE switch 328 is turned on, and the pre-charge voltage generated by the amplifier is now also passed to the blue sub-pixel, as its pre-charge signal 309. In the example of FIG. 4B, the intervals by which the three pre-charge signals are respectively shifted or staggered from one another is shown as being a single delay time interval Δt. However, this is by no means required, and in alternate examples the MUX3 BLUE switch 328 may be turned on at a different time than t=t0+2Δt. In general, therefore, the second MUX switch may be turned on at a time $t=t0+\Delta t_1$, and the third MUX switch may be turned on at a time $t=t0+\Delta t_1+\Delta t_2$, where $\Delta t_1$ does not equal $\Delta t_2$. For the general case of a set of pixels having more than three pixels, for example, following a first pre-charge signal being applied to a first pixel of the set, subsequent pre-charge signals may be applied, in sequence, to each remaining pixel of the set, such that the start of the pre-charge signal for a Kth pixel is delayed by a time Δtk from the start of a corresponding pre-charge signal for the (K−1)th, or previous, pixel, where each time Δtk may be different for each pixel (besides the first pixel of the set, which has no delay). In FIG. 4B, pre-charge signals 309 are shown in a dashed line, and pixel signals 307 in a solid line.

Continuing with reference to FIG. 4B, following time t=t0+2Δt 325, the pre-charge voltage continues to be applied to MUX1 until its pre-charge signal 309 ends, at which time the pixel signal 307 for the red sub-pixel is applied, as shown. Thus, the total signal applied to the red sub-pixel is actually the combined pre-charge signal 309 and pixel signal 311. This combined signal 311 begins at time t=t0, and ends once both signals 309 and 307 have completed. On the other two sub-pixels of this set, the pre-charge signal on each of them ends at some time prior to the end of the pixel signal 307 for the red sub-pixel. Once the MUX1 RED 326 switch is turned off, then the MUX2 GREEN 327 switch is turned on for the duration of its pixel signal 307, to allow the amplifier to drive the green sub-pixel, and once MUX2 GREEN 327 is turned off, then MUX3 BLUE 328 switch is turned on for the blue sub-pixel's pixel signal 307, to allow the amplifier to drive the blue sub-pixel with its appropriate brightness voltage. Shortly thereafter the horizontal period 305 ends, and the process is repeated. The staggering of the start of the respective pre-charge signals 309 from one sub-pixel to the next, as noted, reduces EMI noise.

As shown in the example of FIG. 4B, MUX1 RED 326 is turned off before the actual charging of MUX2 GREEN 327 is turned on. Generally, as shown, the pre-chare signal 309 of MUX2 327 is turned off before the longer combined pre-charge and pixel signal 311 of MUX1 326 ends. However, this is not a requirement, and in alternate embodiments (not shown) the pre-charge signal 309 of MUX2 327 may still remain on when MUX1 326 is turned off.

As is indicated in FIG. 4B at 312, there is an overlap in time of 2Δt between the time that the pre-charge voltage 309 on the red sub-pixel ends, and the pre-charge signal 309 on the blue sub-pixel ends. A similar overlap of Δt occurs between the end of the green sub-pixel's pre-charge signal and the beginning of the red sub-pixel's pixel signal. During these overlapping times the red sub-pixel is driven with its actual pixel signal voltage (that causes it to luminesce with the desired brightness as determined by the image then being displayed), and is thus receiving its pixel signal 307. However, as described above, because all three sub-pixels are connected to a single amplifier, which may only output one voltage at a time, during this overlapping time period 312 the pre-charge voltage (on each of the green and blue sub-pixels) that is output by the amplifier will be the same as the actual pixel signal voltage that is provided to the red sub-pixel, and this voltage may be either larger or smaller than the actual voltage later supplied to each of the green and blue sub-pixels in their respective pixel signals. In such cases, during the overlapping a different voltage may be applied for pre-charge signals 309 for each of the green and blue sub-pixels than the needed voltage that is applied to each of them during their actual pixel signals 307. If this were to last for a significant time, the green and blue sub-pixels may appear as too bright (if the red subpixel's brightness was higher than theirs during the horizontal period), or too dark (if the red subpixel's brightness was lower than theirs during the horizontal period), and distort the image. In one or more embodiments, because the pre-charge signals last for very short time intervals, this is not a problem, as the human eye is incapable of detecting the voltage difference between a higher (or lower) pre-charge signal and a lower (or higher) pixel signal for the same sub-pixel in a horizontal period, and thus no picture deterioration is seen.

It is here noted that while in the examples depicted in FIGS. 3A through 4E the first sub-pixel that is driven in each row is depicted as being the "red" sub-pixel, this is not at all required, and is understood to be merely exemplary. Thus, in any given embodiment, the three sub-pixels, red, green and blue, may be driven in any order, and any of them may be the first sub-pixel driven in a given horizontal period of a display device.

In one example, the time periods shown in FIG. 4B may have the following values, which are understood as being exemplary, and not limiting, as many other values are possible, all within the scope of this disclosure. Horizontal period 305 may be, for example, 16 microseconds, and a pixel signal 307 may have a duration of, for example, 3.0 microseconds. A pre-charge signal 309 may last for 2.5 microseconds, and, as a result, a duration of a combined signal 311 may be 5.5 microseconds, for example. The delay Δt may be, for example, anywhere between 0.5-1.5 microseconds. As noted, in order to obtain the benefits of EMI improvement in accordance with various embodiments, the pre-charge signals for a set of sub-pixels are shifted/staggered, and thus applied with a slight delay Δt from one to the next. However, if delay Δt is too long, the effect is similar to that of conventional driving, as shown in FIG. 3A, where MUX1, MUX2 and MUX3 are each turned on sequentially, and the effect of the pre-charge signal is not felt by the given sub-pixel. On the other hand, if the delay Δt is too short, the effect is similar to that of conventional pre-charge timing, as shown in FIG. 3B, where the effect of staggering is not felt. Thus, in accordance with various embodiments, an optimal delay lies somewhere between these two poles. As noted, in the example described above, for a horizontal period of 16 microseconds, a pre-charge signal duration of 2.5 microseconds, and a pixel signal duration of 3.0 microseconds, an example delay may be between 0.5-1.5 microseconds. In other embodiments, in other examples, other delay intervals may be appropriate.

As noted above, the delay Δt need not be uniform between any two switches connected to a given amplifier. Thus, for example, in the general sense, Δt may be different between two or more, or even all, of the delays. Accordingly, for a set of N pixels that are connected to a single amplifier, where the N pixels are indexed by an integer K, the start of a pre-charge signal for a Kth pixel is delayed by a time Δtk from the start of the pre-charging signal for the (K−1)th, or previous, pixel of the set, where each delay Δtk is different for each pixel or sub-pixel.

In accordance with various embodiments, the pre-charge signal 309 for a pixel reduces the noise that occurs when the same switch is later turned on in the horizontal period. This is due to the fact that a charge remains on the source lines and pixels, or sub-pixels, as the case may be, after the switch for that respective pixel has been turned off. Thus, for example, the pre-charge signals 309 applied to each of the green and blue MUX switches at the beginning of a horizontal period reduces the switching noise when the same respective switches are again turned on, later in the same horizontal period, such as, for example, when each of the MUX2 GREEN 327 and MUX3 BLUE 328 switches are later turned on for their pixel signals. In some embodiments, because the pre-charge signal serves to pre-charge a capacitance of each source line and (sub) pixel, the time duration of a pixel signal period 307 may generally be shortened.

FIG. 4C illustrates an alternate example of the timing diagram shown in FIG. 4B, where, for the first sub-pixel, namely the red sub-pixel, the pre-charge signal 309 drops to low prior to the pixel signal 307 going high, according to one or more alternate embodiments. Thus, as shown in FIG. 4C, for the MUX1 RED 326 signal, pre-charge signal 309 ends, and drops to low, prior to the beginning of pixel signal 309 going high. This example, which is a variant of the timing diagram shown in FIG. 4B, illustrates that, while possible, and perhaps convenient, it is not necessary to join the pre-charge signal 309 and the following pixel signal 307 for any pixel of the set for which the pixel driving signal 309 immediately follows the corresponding pre-charge signal 307. It is noted in this regard that FIGS. 4D and 4E, next described, include several examples of pixels (other than the first pixel) where the pixel signal immediately follows the end of the pre-charge signal, and they may, in one or more embodiments, be either joined, as shown in FIG. 4B, or they may not be joined, as shown in FIG. 4C, for example.

Figure 4E:
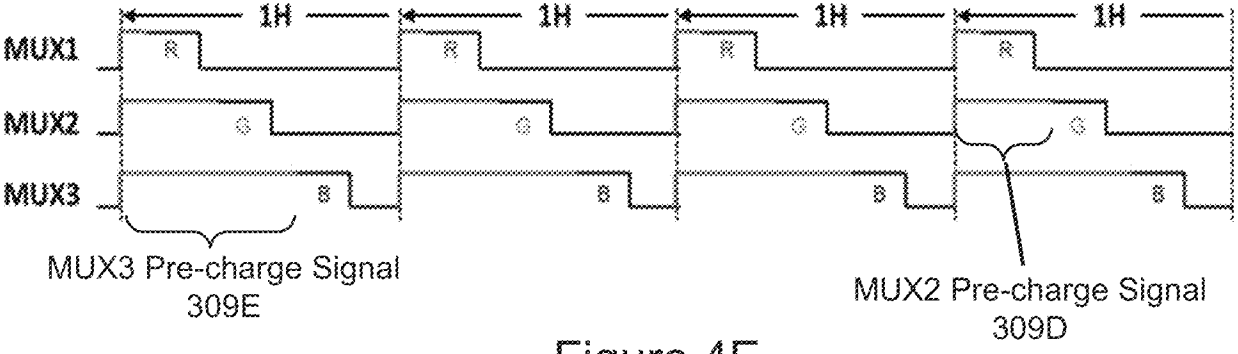
FIG. 4E illustrates still another alternate set of driving signals, according to one or more embodiments.

FIGS. 4D and 4E illustrate alternate timing diagrams for respective pre-charge and pixel signals in alternate exemplary embodiments. The respective embodiments shown in each of FIGS. 4D and 4E do not utilize time shifting or staggering of the respective pre-charge signals, but rather, they use different durations of each pre-charge signal in the set of (sub) pixels to reduce EMI noise. However, with reference to the example timing diagrams shown in FIGS. 4D and 4E, in still alternate embodiments that are variations of the examples shown in FIGS. 4D and 4E, the timing diagrams may be further modified to stagger/shift the pre-charge signals 309 shown in each of FIGS. 4D and 4E by some delay Δt between successive pixels or sub-pixels, which will also serve to reduce EMI. As noted, the delay Δt need not be uniform between any two switches connected to a given amplifier, and thus between any two successive pixels. Thus, with reference to FIG. 4D, there is a different duration of the pre-charge signal 309D for the MUX2 switch, which, in this example, is for the green sub-pixel. Pre-charge signal 309D lasts about three times as long as the pre-charge signals for each of the MUX1 and MUX3 switches, which are the same in this example. It is noted, though, that there is a drawback in the example pre-charge timing scheme of FIG. 4D, in that the load capacitance will be doubled during charging of the red sub-pixel (MUX1), because during the entire duration of the pixel signal for the red sub-pixel, when the MUX1 switch is on, the MUX2 switch for the green sub-pixel is also on. It is noted that, as described above with reference to FIG. 4C, the pre-charge signal 309D on MUX2 for the green sub-pixel goes low just before the immediately following pixel signal 307D for the same green sub-pixel goes high. Accordingly, this is another example where there is no combined pre-charge and pixel signal, as described above with reference to FIG. 4C.

Similarly, with reference to FIG. 4E, still another alternate example timing diagram is shown, according to another alternate embodiment. In this example timing scheme, each pre-charge signal runs from the beginning of the horizontal period (as noted above, they are not shifted/staggered in this example) up and until the corresponding pixel signal begins, such that for each sub-pixel, there is a combined pre-charge and pixel signal that gets longer and longer for each successive sub-pixel in the set. Thus, for example, the last sub-pixel in the set, namely the blue sub-pixel, has a MUX3 pre-charge signal 309E that lasts longer than each of the combined pre-charge and pixel signals, for each of the red and green sub-pixels. Similarly, MUX2 pre-charge signal 309D lasts longer than the entire combined pre-charge and pixel signal for the red sub-pixel. Understood another way, in the example timing diagram of FIG. 4E each MUX switch remains closed from the beginning of the horizontal period until the end of its respective sub-pixel's pixel signal has ended. As a result, each pre-charge signal is longer than the one for the previous sub-pixel, as shown, and thus, overall, the MUX switches are closed, and thus on, for a much longer time per horizontal period than in any of the previously described example timing diagrams. This implicates a potential drawback of the alternate timing scheme of FIG. 4E, namely that the amplifier load capacitance will be trebled during charging of the red sub-pixel (MUX1), because during the entire combined signal for the red sub-pixel (MUX1), both the MUX2 switch for the green sub-pixel, and the MUX3 switch for the blue sub-pixel, are both also on. Moreover, the load capacitance will be doubled during the charging of the green sub-pixel (MUX2), because during the entire combined signal for the green sub-pixel (MUX2), the MUX3 switch for the blue sub-pixel is also on. In some cases, an increased load capacitance may deteriorate the brightness supplied to each sub-pixel, and thus reduce image quality. However, in one or more embodiments that may use the timing diagram of FIG. 4E, if the amplifier driving the set of sub-pixels has sufficient ability to drive the increased load capacitance, the example timing illustrated in FIG. 4E may be utilized without picture deterioration, and, as noted, its benefits as regards EMI mitigation may be realized. As noted above, in alternate examples that use a variation of the FIG. 4E timing diagram, staggering/shifting of the pre-charge signals may also be implemented, to reduce EMI.

Figure 5A:
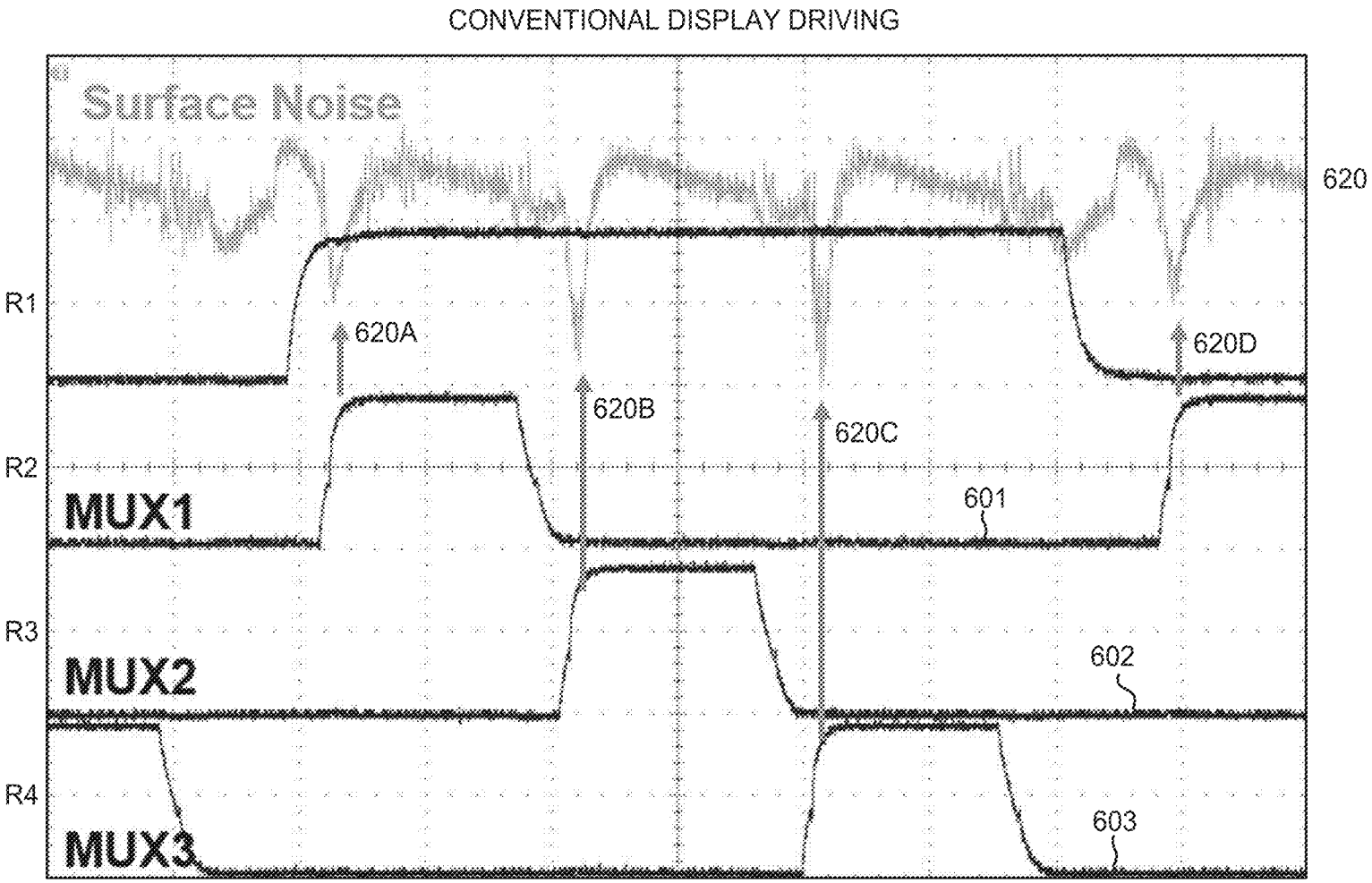
FIG. 5A is an example plot of driving conventional signals of FIG. 3A and corresponding surface noise.

FIG. 5A is an example plot of conventional driving signals for three sub-pixels and corresponding surface noise for a single example horizontal period of a display device. The pixel driving signals do not have corresponding pre-charge signals, and thus FIG. 5A illustrates the conventional case depicted in FIG. 3A. As shown in FIG. 5A, there is a jump in the noise signal just when each MUX switch is turned on. In the example plot of FIG. 5A, the y-axis units for each of the MUX1 601, MUX2 602 and MUX3 603 voltage plots is 10V, and the y-axis unit for the noise plot 620 is 100 mV. Thus, for example, there is a spike in noise at time 620A, when MUX1 is turned on, at 620B when MUX2 is turned on, and finally, at 620C, when MUX3 is turned on. There is a further spike in noise signal 620 at time 620D, when the MUX1 switch is turned on a second time at the beginning of a second horizontal period, as shown at the far left of the figure. It is noted that the noise signal 620 as plotted in FIG. 5A increases in the downward direction, and thus the lower the peak, the greater the noise. It is precisely these noise spikes that are mitigated in accordance with one or more embodiments.

Figure 5B:
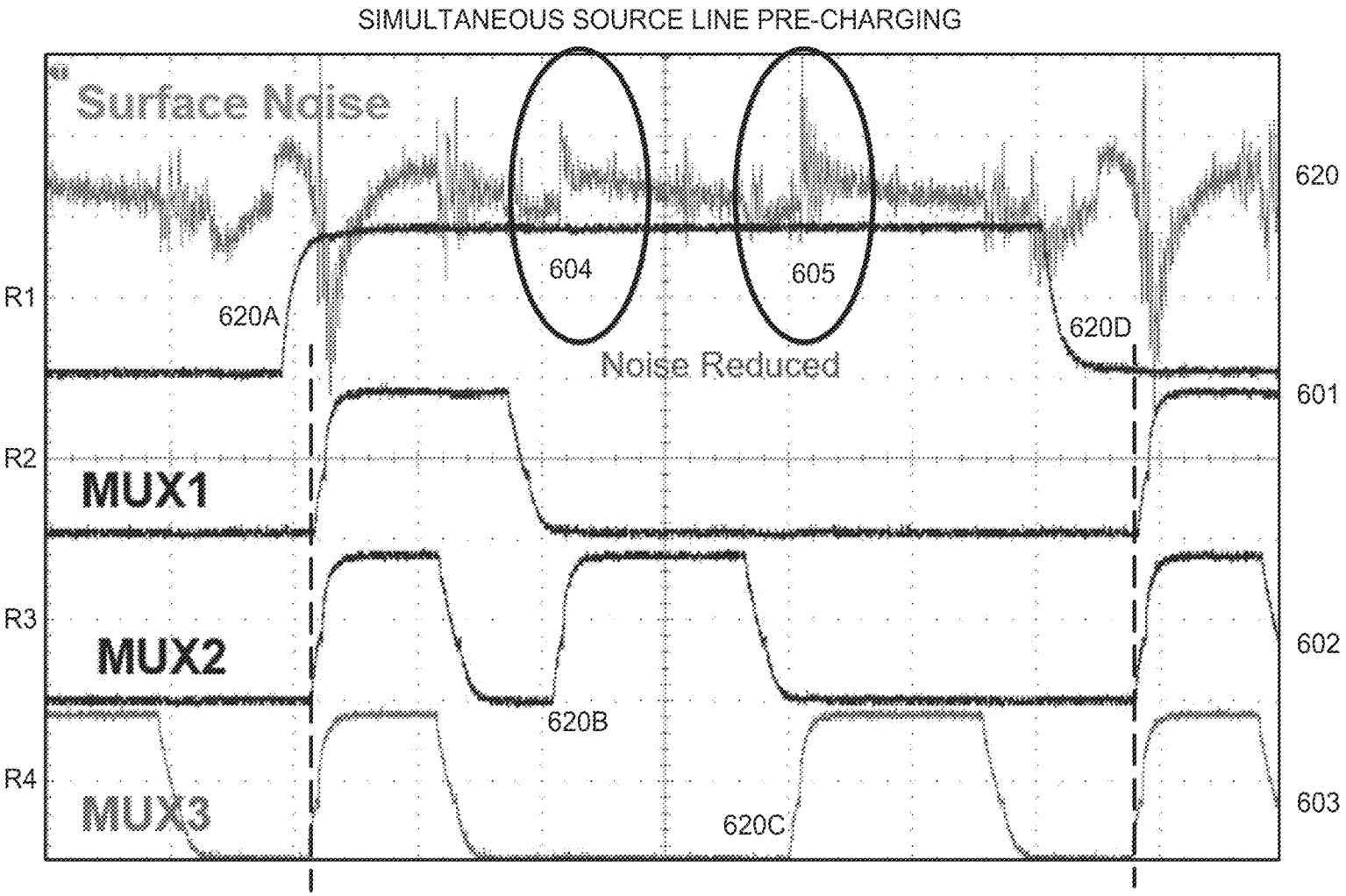
FIG. 5B is an example plot of driving conventional signals of FIG. 3B and corresponding surface noise.
Figure 6:
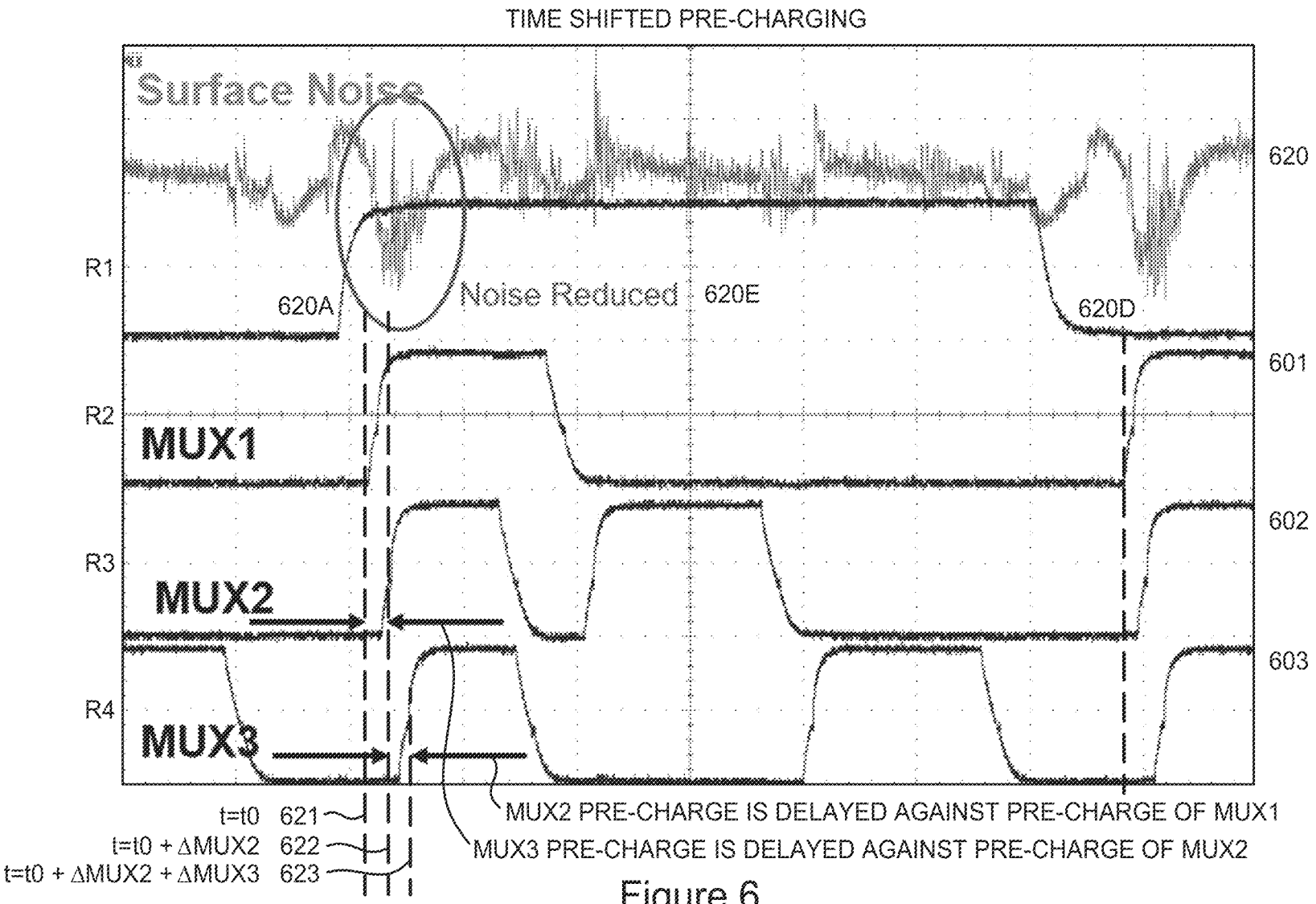
FIG. 6 is an example plot of driving signals with shifted pre-charge signals and corresponding surface noise, according to one or more embodiments.

Similarly, FIG. 5B is an example plot of driving conventional signals for the same three sub-pixels shown in FIG. 5A, using the same timing for the pixel signals as is shown in FIG. 5A. However, in the timing diagram of FIG. 5B, simultaneous conventional pre-charge signals are also applied to each sub-pixel, as shown at the beginning of the horizontal period (at time 620A), such as is illustrated in FIG. 3B, described above. As shown in FIG. 5B, the noise at points 620B and 620C of FIG. 5A, when MUX 2 and MUX3 were each respectively turned on, has now been reduced, as shown in ovals 604 and 605 of FIG. 5B. However, as also shown in FIG. 5B, the spike in noise just after time 620A, when all three of MUX1, MUX2 and MUX3 are turned on for the conventional simultaneous pre-charge signal, and also just after time 620D, when the same three switches MUX1, MUX2 and MUX3 are turned on a second time at the beginning of the next horizontal period, has not been reduced, and remains significant. In fact, by comparing noise signal 620 in each of FIGS. 5A and 5B, it is seen that the noise at time points 620A and 620D shown in FIG. 5B for the conventional simultaneous pre-charge approach, is even greater than any of the noise spikes seen in FIG. 5A, where there is no pre-charging at all. To address this problem, in one or more embodiments this noise may be significantly lessened, using an exemplary staggered/shifted timing protocol, such as is illustrated in FIGS. 4A, 4B and 4C. FIG. 6 illustrates the reduced noise seen when using the example staggered timing diagram of FIGS. 4A and 4B, as next described.

FIG. 6 is an example plot of the same driving signals for the same three sub-pixels as are depicted in each of FIGS. 5A and 5B, and the corresponding surface noise, when staggering of the three pre-charge signals relative to each other is performed, such as is illustrated in FIGS. 4A and 4B, and described above, according to one or more embodiments. As shown in oval 620E, the noise signal when each of MUX2 and MUX3 are first turned on, for pre-charge signals that each begin after a pre-defined time delay from the previous pre-charge signal, is significantly reduced from the noise that occurs when each MUX switch is simultaneously turned on as shown at point 620A of FIG. 5B. Thus, with reference to FIG. 6, at time t0 621 the first pre-charge signal, for MUX1, goes high and turns on the switch. At time t=t0+ΔMUX2 622, a second pre-charge signal is applied, turning on MUX2. Finally, at time t=t0+ΔMUX2+ΔMUX3 623, a third pre-charge signal is applied to MUX3 to turn it on. In this example there are only three switches, and thus three sub-pixels, connected to the same amplifier. However, it is understood that in alternate embodiments, with either two, or more than three MUX switches per amplifier, each successive MUX switch would be turned on after some pre-defined delay, which may or may not be equal to any other delay in the staggering schema. For examples with more than two switches, as noted, in some embodiments the delays ΔMUX2, ΔMUX3, . . . , ΔMUXN may be identical. In other embodiments, they may be different. In this example the respective delays between successive pixels, namely ΔMUX2 and ΔMUX3, may be, for example, unequal. In other embodiments they may be equal, and thus there may be, in such embodiments, a single delay Δt applied to the start of each successive pre-charge signal. In alternate embodiments, such as, for example, as shown in FIGS. 4D and 4E, there may be no delays at all, but the length of the pre-charge signals may be different for any given two pixels. In still alternate embodiments, some of the pre-charge signals may have the same time interval, and others may have a different value. Thus, for example, with reference again to FIG. 4D, the pre-charge signals on MUX1 and MUX3 are substantially equal, but the pre-charge signal 309D on MUX2 is approximately three times as long as the other two pre-charge signals. In alternate embodiments, which use variations of the timing diagrams shown in each of FIGS. 4D and 4E but also implement staggering/shifting of the pre-charge signals to reduce EMI, the respective delays between successive pixels (or sub-pixels) may be equal, or unequal, from one pixel to a subsequent pixel.

Figure 7:
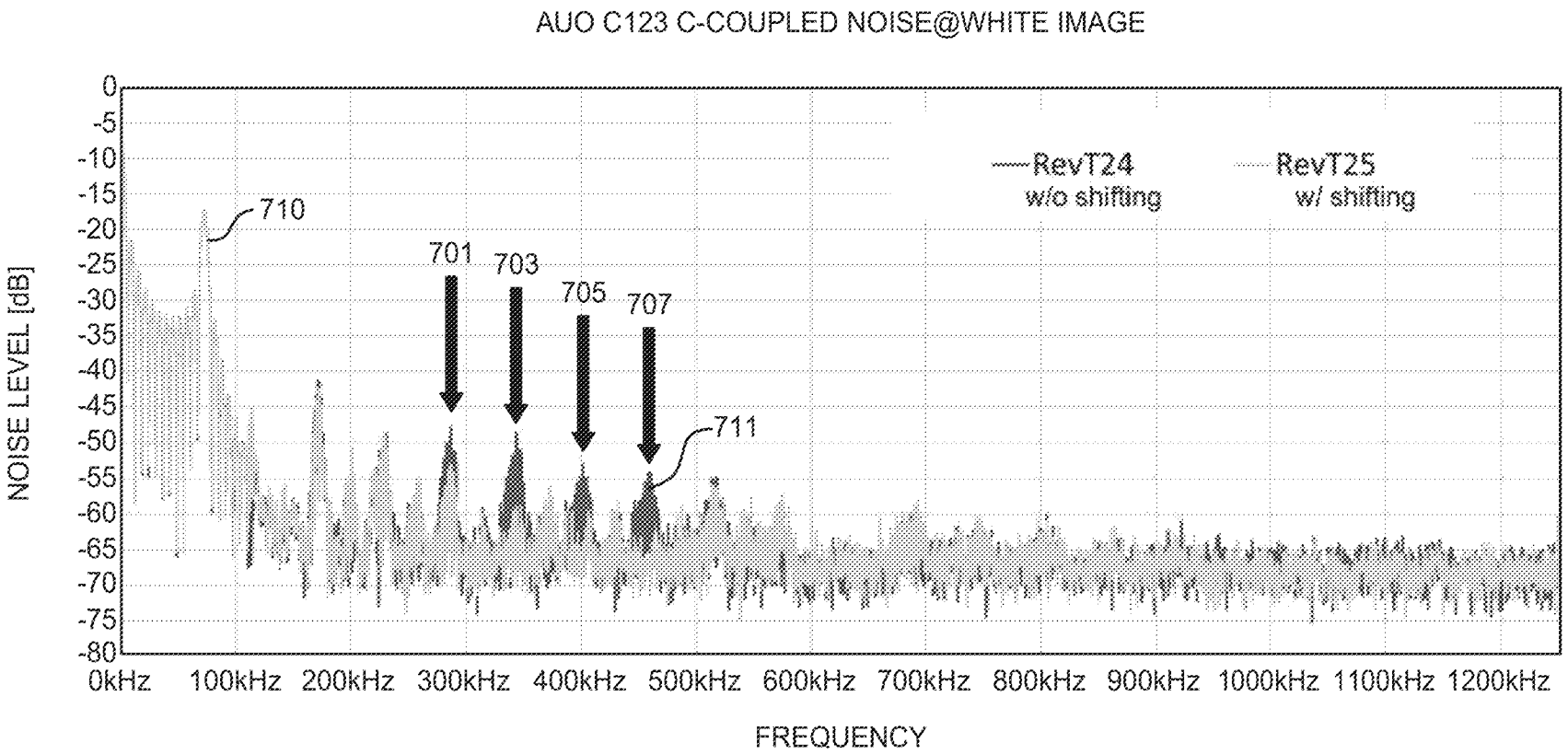
FIG. 7 is an example plot of noise level versus frequency for an example display panel implementing the example sub-pixel driving signals illustrated in FIGS. 4A and 4B, according to one or more embodiments.

FIG. 7 is an example plot of noise level versus frequency for an example display panel implementing two different pixel driving schemas. The lighter shaded plot, plot 710 is for a timing schema termed "RevT25", which used the example timing diagram illustrated in FIGS. 4A and 4B, according to one or more embodiments. The darker shaded plot, plot 711, is for a timing schema termed "RevT24", which used the conventional simultaneous pre-charge signaling shown in FIG. 3B. As shown in FIG. 7, the noise level for plot 711, for the simultaneous pre-charge signaling of RevT24, has significant noise at points 701 (293 kHz), 703 (352 kHz), 705 (411 kHz) and 707 (470 kHz). These represent the 5th 6th 7th and 8th harmonics of the noise of one horizontal period of, in this example, 58.7 kHz. However, for these same frequencies, plot 710, which represents the shifted/staggered pre-charge signals in accordance with one or more embodiments, shows the noise being considerably diminished, as expected.

Figure 8:
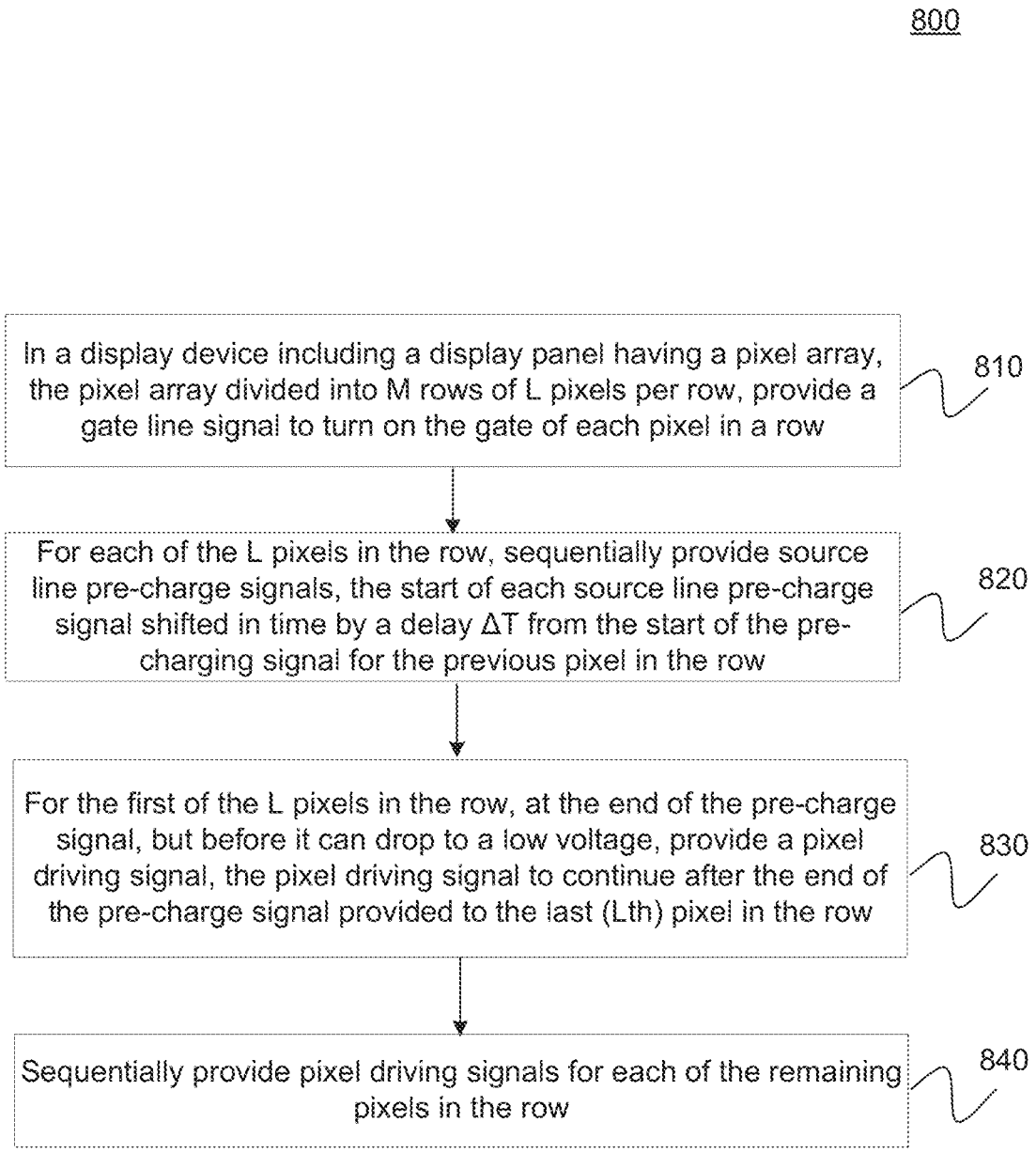
FIG. 8 is a process flow chart for an example method for driving sub-pixels in a display device, according to one or more embodiments.

FIG. 8 illustrates a method of driving sub-pixels in a display device so as to minimize or otherwise reduce the generation of EMI noise, according to one or more embodiments. For example, the display device may be disposed in an automobile. For example, the display device may include a display panel having a pixel array, the pixel array divided into M rows of L pixels per row. For example, each row of the pixel array may be driven by, and thus connected to, a single amplifier, such as is shown in the first three columns of the pixel array 165 of FIG. 2 (representing a single pixel in each of the three depicted rows). In the example method of FIG. 8, the timing schema illustrated in FIGS. 4A and 4B is used, but as described above, in alternate examples, other methods may be implemented using the timing schemas of any of FIG. 4C, 4D or 4E.

Method 800 includes blocks 810 through 840. In alternate embodiments, method 800 may have more, or fewer, blocks. Method 800 begins at block 810, where a gate line signal is provided to turn on the gate of each pixel in a row. For example, the row may be any of the M rows of the pixel array. For example, the pixel array may be pixel array 165 of FIG. 2, and the row may be row B 167 of pixel array 165. Thus, for example, the gate line signal may be provided by gate driver B, across gate line 2 156.

From block 810, method 800 proceeds to block 820, where, for each of the L pixels in the row, source line pre-charging signals are sequentially provided, where the start of each source line pre-charge signal is shifted in time by a delay ΔT from the start of the pre-charge signal for the previous pixel in the row. For example, the delay ΔT may be uniform for the entire row, and the pre-charge signals may be those shown in FIGS. 4A and 4B, for a row of three sub-pixels. The first pre-charge period, for example, for a red sub-pixel, may begin at time t=t0, the second pre-charge period, for a green sub-pixel, for example, may begin at time t=t0+ΔT, and the third pre-charge period, for example for a blue sub-pixel, may begin at time t=t0+2ΔT.

From block 820, method 800 proceeds to block 830, where, for the first of the L pixels in the row, at the end of the pre-charge signal, but before it can drop to a low voltage, a pixel driving signal is provided, the pixel driving signal to continue after the end of the pre-charge signal provided to the last (e.g., the Lth) pixel in the row. For example, as shown in FIG. 4B, the pixel driving signal 307 applied to the red sub-pixel, by turning on switch MUX1 RED 326, stays high for some time interval following the end of the pre-charge period 309 applied to the blue sub-pixel, which is the last sub-pixel in the set. As described above, this feature is only exemplary, and in alternate embodiments, need not be implemented, and the pre-charge signals on one or more later pixels or subpixels in the row (or any other set of pixels) may last longer than the pixel signal for an earlier pixel or sub-pixel of the row (or other set).

From block 830, method 800 proceeds to block 840, where, pixel driving signals are provided for the remaining pixels in the row. For example, again with reference to FIG. 4B, after the pixel driving signal for the red sub-pixel has been applied, MUX2 GREEN 327, and MUX3 Blue 328 switches are sequentially turned on, and the pixel driving signal to each of the green and blue sub-pixels is then applied, completing the horizontal period.

In one or more embodiments, a calibration process may be performed to determine the optimal shifting/staggering timing of pre-charge signals, so as to comply with a given maximum allowed, or, for example, a maximum preferred EMI noise specification, in accordance with various embodiments. Thus, for example, a first pre-charge timing may be set for a source line pre-charge schema such as is shown in FIGS. 4A and 4B. Using the first pre-charge timing, the EMI noise level is measured. After measurement of the EMI noise level, it is determined if the specification is met. If yes, then the calibration process terminates. If, however, it is determined that the first pre-charge timing does not meet the specification, then the shifting of the pre-charge signals is adjusted to a second pre-charge timing, and the EMI level once again measured. This process is repeated, if necessary, until a third, fourth, or Nth pre-charge timing schema does satisfy the desired specification, and the process then terminates.

In one or more embodiments, a given display device by be disposed in handheld electronic device, disposed in a vehicle, disposed in a public kiosk, used in a private kitchen, or the like. In one or more embodiments, the display device may include a display panel, which has an array of pixels, such as, for example, M rows and N columns. Within each row, several pixels, for example L pixels, where L is 1, 2, 3, 6 or 12, may be connected to a single amplifier or signal source, through a switch, such as, for example, a MUX switch. When a row of the pixel array is enabled, all of the L pixels, or, as the case may be, sub-pixels, that are connected to a single amplifier may be driven with both a pre-charge signal and a pixel signal, in each horizontal period of the display device. In one or more embodiments, the pre-charge signals are applied at the beginning of the horizontal period, but shifted or staggered one from the other. In one or more embodiments, by shifting/staggering the pre-charge voltages one from the other by a pre-defined delay, EMI noise is reduced. It is noted that any example described above where a row of pixels is used is exemplary only and not limiting. Thus, in one or more embodiments, any set of pixels that is connected to a single amplifier may be driven using the disclosed techniques, the pixels not being restricted to any row, or to any other structure of a given display panel.

The embodiments and examples set forth herein were presented in order to best explain the embodiments in accordance with the present technology and its particular application and to thereby enable those skilled in the art to make and use the disclosure. However, those skilled in the art will recognize that the foregoing description and examples have been presented for the purposes of illustration and example only. The description as set forth is not intended to be exhaustive or to limit the disclosure to the precise form disclosed.

In view of the foregoing, the scope of the present disclosure is determined by the claims that follow.

What is claimed is:

1. A method of driving pixels of a display device, comprising:

for a set of N pixels of the display device that are connected to a switch, each of the N pixels to be driven during a time period T:

applying, to a first pixel of the set of N pixels, a first pre-charge signal; and applying, in sequence, to each remaining pixel of the set of N pixels, a corresponding pre-charge signal, such that a start of a pre-charge signal for a Kth pixel is delayed by a time Δtk, from a start of a pre-charge signal for the (K−1)th pixel;

applying, to each pixel of the set of N pixels, a pixel driving signal, wherein the first pre-charge signal, the corresponding pre-charge signal, and the pixel driving signal are voltage pulses.

2. The method of claim 1, wherein N pre-charge signals have the same duration in time.

3. The method of claim 1, wherein a plurality of pixels of the set of N pixels each include a MOSFET, and each of the first pre-charge signal, the corresponding pre-charge signal, and the pixel driving signal are applied to a source input of the MOSFET.

4. The method of claim 1, wherein at least one of:

the time Δtk is different for two or more pixels in the set of N pixels; or two or more of N pre-charge signals have different durations in time.

5. The method of claim 1, wherein the time Δtk is the same for each remaining pixel.

6. The method of claim 1, wherein the time Δtk for the Kth pixel is less than the duration of the pre-charge signal for the (K−1)th pixel.

7. The method of claim 1, wherein the time period T is a horizontal refresh period of the display device.

8. The method of claim 1, wherein a time period for two or more pre-charge signals overlap.

9. A display device, comprising:

a display panel including a plurality of pixels;

a gate driver, configured to enable the plurality of pixels;

a display driver coupled, via a multiplexing switch, to each pixel of the plurality of pixels; and a processor, coupled to the gate driver and the display driver, configured to control:

the gate driver, to enable the plurality of pixels; and the display driver, to:

apply, to a first pixel of the plurality of pixels, a first pre-charge signal; and apply, in sequence, to each of remaining pixels of the plurality of pixels, a corresponding pre-charge signal, such a start of a pre-charge signal for a Kth pixel of the plurality of pixels is delayed by a time Δtk from a start of a pre-charge signal for the (K−1)th pixel of the plurality of pixels;

apply, to each pixel of the plurality of pixels, a pixel driving signal, wherein the first pre-charge signal, the corresponding pre-charge signal, and the pixel driving signal are voltage pulses.

10. The display device of claim 9, wherein the time Δtk is shorter than a duration of the pre-charge signal for the (K−1)th pixel.

11. The display device of claim 9, wherein pre-charge signals for pixels in a row all have the same duration in time.

12. The display device of claim 9, wherein each pixel of a row includes a MOSFET, and wherein the display driver is further configured to apply each pre-charge signal and each pixel driving signal to a source input of the MOSFET.

13. The display device of claim 9, wherein the time Δtk is the same for each of the plurality of pixels in a row.

14. The display device of claim 9, wherein the processor is further configured to apply a pixel signal to each pixel in a row.

15. The display device of claim 9, wherein the processor is further configured to apply the first pre-charge signal and a first pixel driving signal as one contiguous signal.

16. The display device of claim 9, wherein a time period for two or more pre-charge signals overlap.

17. A method for driving a set of pixels of a display device, comprising:

setting, within a pre-defined period of the display device, a pre-charge signal to be followed by a pixel driving signal for each pixel in the set of pixels;

setting the pre-charge signal for a first pixel of the set of pixels at a beginning of the pre-defined period;

for each remaining pixel in the set of pixels, staggering a beginning of each corresponding pre-charge signal so that there is a minimum delay between any two pre-charge signals;

driving the set of pixels during one or more pre-defined periods;

measuring a level of electromagnetic interference (EMI) generated when driving the set of pixels; and in response to determining that a value for the EMI does not meet a maximum EMI level, recursively:

increasing the minimum delay;

measuring a further level of EMI generated by driving the set of pixels with the increased minimum delay until the further level of EMI is less than the maximum EMI level.

18. The method of claim 17, wherein the set of pixels is an ordered set, and further comprising staggering a beginning of each successive pixel's pre-charge signal so that it is delayed by the minimum delay from a pre-charge signal of its immediately prior pixel in the ordered set.

19. The method of claim 17, wherein a time period for two or more pre-charge signals overlap.

* * * * *